US009711866B1

(12) United States Patent
Doane et al.

(10) Patent No.: US 9,711,866 B1
(45) Date of Patent: Jul. 18, 2017

(54) STACKED PARASITIC ARRAY

(75) Inventors: Jonathan P. Doane, Cedar Rapids, IA (US); Dana J. Jensen, Marion, IA (US); Lee M. Paulsen, Cedar Rapids, IA (US); James B. West, Cedar Rapids, IA (US); Matilda G. Livadaru, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 1319 days.

(21) Appl. No.: 12/974,853

(22) Filed: Dec. 21, 2010

(51) Int. Cl.
*H01Q 21/00* (2006.01)
*H01Q 19/10* (2006.01)
*H01Q 19/13* (2006.01)

(52) U.S. Cl.
CPC ..... *H01Q 19/13* (2013.01)

(58) Field of Classification Search
USPC ..... 343/837
See application file for complete search history.

(56) References Cited

U.S. PATENT DOCUMENTS

| | | | | |
|---|---|---|---|---|
| 2,583,745 | A * | 1/1952 | Miller | 343/727 |
| 4,101,902 | A * | 7/1978 | Trigon | 342/374 |
| 4,843,402 | A * | 6/1989 | Clement | 343/758 |
| 5,534,880 | A | 7/1996 | Button et al. | |
| 6,407,719 | B1 * | 6/2002 | Ohira et al. | 343/893 |
| 2005/0128148 | A1 * | 6/2005 | Anguera Pros et al. | 343/7 MS |
| 2008/0036669 | A1 * | 2/2008 | Crouch et al. | 343/757 |
| 2009/0237314 | A1 * | 9/2009 | Lalezari | 343/721 |

* cited by examiner

*Primary Examiner* — Graham Smith
(74) *Attorney, Agent, or Firm* — Angel N. Gerdzhikov; Donna P. Suchy; Daniel M. Barbieri

(57) ABSTRACT

The present disclosure is directed to a stacked parasitic array. The stacked parasitic array may include a stack of multiple parasitic antenna arrays (ex.—layers). Each of the parasitic antenna arrays (ex.—layers) may be independently tuned for multiband operation or, alternatively, the parasitic antenna arrays (ex.—layers) may be designed for common band and fed coherently as a collinear array for promoting increased gain and elevation beam steering.

21 Claims, 8 Drawing Sheets

STACKED PARASITIC ARRAY

CROSS-REFERENCE TO RELATED APPLICATIONS

U.S. patent application Ser. No. 12/729,372 entitled: An Improved Parasitic Antenna Array Design for Microwave Frequencies filed Mar. 23, 2010 is hereby incorporated by reference in its entirety herein.

FIELD OF THE INVENTION

The present disclosure relates to the field of antenna technology (ex.—multifunction antennas) and particularly to a stacked parasitic array.

BACKGROUND OF THE INVENTION

Currently available parasitic antenna arrays may implement variable reactance via a single component, such as a PIN diode, a varactor diode, or a variable capacitor. Further, with said currently available parasitic antenna array implementations, a standard DC bias network may be attached which uses a large resistance or inductance for an RF choke. In these currently available implementations, the effects of the interconnect impedance (such as via inductance) are neglected. Such effects may become increasingly significant at higher frequencies, especially if tuned structures, such as quarter wavelength lines, are used. Thus, these currently available implementations fail to produce the requisite impedances for proper high efficiency operation of a parasitic array at higher microwave frequencies (ex.—frequencies greater than 3 Gigahertz (GHz)). Further, the currently available antenna arrays may be low gain, large, heavy and/or expensive. Still further, the currently available antenna arrays (ex.—which may include currently available Intelligence, Surveillance and Reconnaissance (ISR) antennas) may be low gain, large, heavy, expensive and/or impractical for implementation with Unmanned Aerial Vehicles (UAV) or soldier platforms. Further, a number of currently available antenna arrays may not provide for wideband or multiband operation.

Thus, it would be desirable to provide a parasitic antenna array implementation which obviates the problems associated with currently available implementations.

SUMMARY OF THE INVENTION

Accordingly, an embodiment of the present disclosure is directed to a stacked parasitic array, including: a first parasitic antenna array; and a second parasitic antenna array, each parasitic antenna array including: a substrate; a monopole element; a ground plane; a plurality of parasitic elements; and a plurality of load circuits, said monopole element being connected to said substrate and being configured for radiating electromagnetic energy in an omni-directional radiation pattern, said ground plane being connected to the second surface of the substrate, said plurality of parasitic elements being connected to the substrate, said plurality of load circuits being connected to the plurality of parasitic elements and being connected to the ground plane, wherein the first parasitic antenna array and the second parasitic antenna array are vertically stacked.

An additional embodiment of the present disclosure is directed to a stacked parasitic array, including: a first parasitic antenna array; and a second parasitic antenna array, the first parasitic antenna array and the second parasitic antenna array being vertically stacked, each parasitic antenna array including: a substrate; a monopole element; a ground plane; a plurality of parasitic elements; and a plurality of load circuits, said monopole element being connected to said substrate and being configured for radiating electromagnetic energy in an omni-directional radiation pattern, said ground plane being connected to the second surface of the substrate, said plurality of parasitic elements being connected to the substrate, said plurality of load circuits being connected to the plurality of parasitic elements and being connected to the ground plane, wherein the first parasitic antenna array and the second parasitic array are configured for being independently tuned, said first parasitic antenna array configured for being tuned to a first frequency band and said second parasitic antenna array configured for being tuned to a second frequency band, the second frequency band being different from the first frequency band.

A further embodiment of the present disclosure is directed to a stacked parasitic array, including: a first parasitic antenna array; and a second parasitic antenna array, the first parasitic antenna array and the second parasitic antenna array being vertically stacked, each parasitic antenna array including: a substrate; a monopole element; a ground plane; a plurality of parasitic elements; and a plurality of load circuits, said monopole element being connected to said substrate and being configured for radiating electromagnetic energy in an omni-directional radiation pattern, said ground plane being connected to the second surface of the substrate, said plurality of parasitic elements being connected to the substrate, said plurality of load circuits being connected to the plurality of parasitic elements and being connected to the ground plane, wherein the first parasitic antenna array and the second parasitic antenna array are tuned to a same frequency band.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present disclosure may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
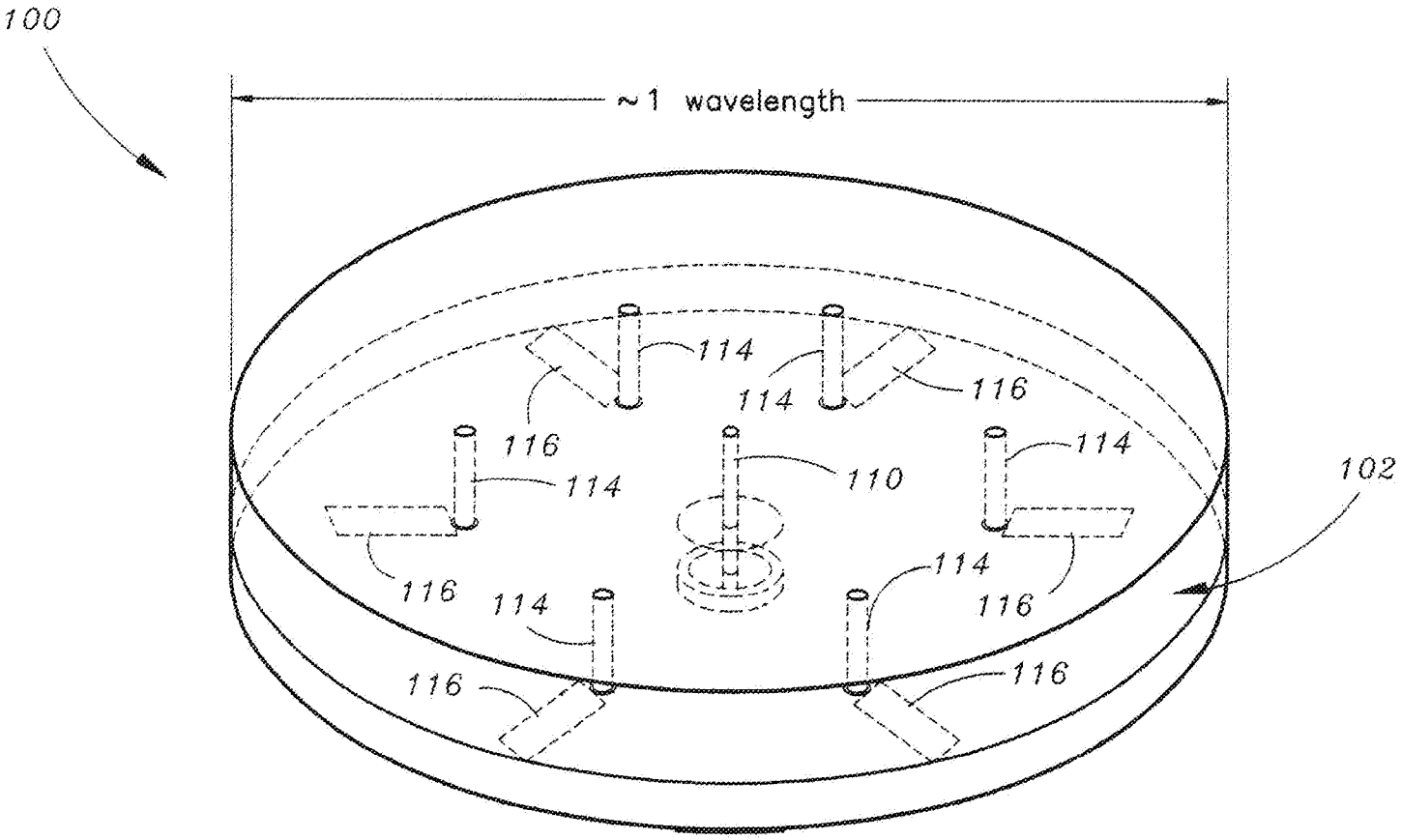
FIG. 1 is a view of a parasitic antenna array in accordance with an exemplary embodiment of the present disclosure.
Figure 2A:
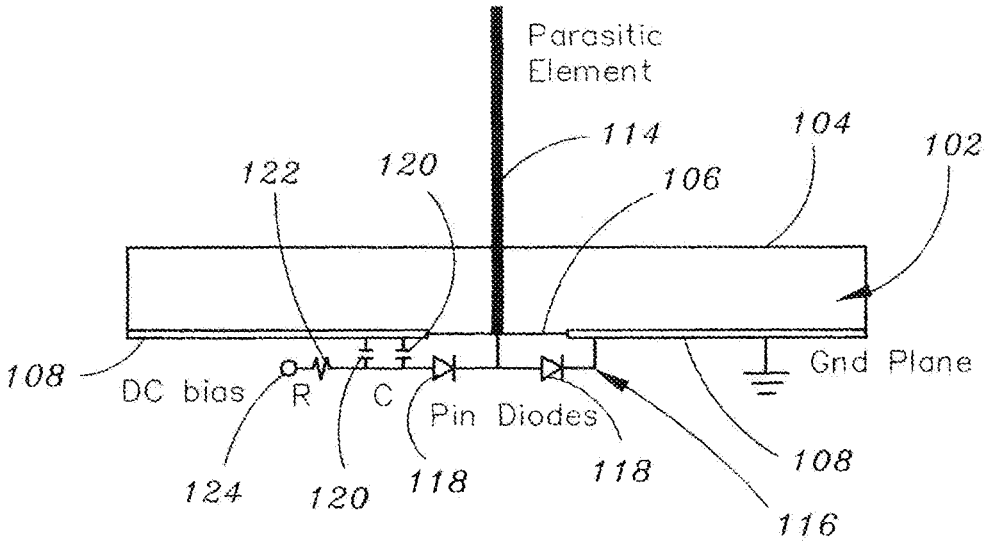
FIG. 2A is a view of a load circuit connected to the substrate of the parasitic array shown in FIG. 1 in accordance with an exemplary embodiment of the present disclosure.

Referring to FIG. 1, an antenna array (ex.—an antenna) in accordance with an exemplary embodiment of the present disclosure is shown. In a current exemplary embodiment of the present disclosure, the antenna array 100 may be a parasitic antenna array (ex.—a parasitic antenna) 100. In further embodiments of the present disclosure, the parasitic antenna array 100 may include a substrate 102. In exemplary embodiments of the present disclosure, the substrate 102 may be at least partially formed of printed circuit board material. Further, the substrate 102 may include a first surface (ex.—a top surface) 104 and a second surface (ex.—a bottom surface) 106 disposed generally opposite the first surface 104. Still further, a ground plane 108 may be connected to (ex.—may be configured on) the bottom surface 106 (as shown in FIG. 2A). In further embodiments of the present disclosure, the length of the antenna substrate 102 may be approximately one wavelength.

In further embodiments of the present disclosure, the parasitic antenna array 100 may further include a central element 110 connected to the substrate 102. For instance, the central element 110 may be a monopole element (ex.—a central monopole element) 110, or may be a monopole-type radiating element 110 (ex.—an ultra-wide band (UWB) monopole structure) that has the proper electrical properties to be suitable for parasitic array application. Further, the central element 110 may be connected to the substrate 102 and the ground plane 108 at a generally central location of the substrate 102 and the ground plane 108 (as shown in FIG. 1). Still further, the central element 110 may be an omni-directional element 110 configured for radiating electromagnetic energy in an omni-directional radiation pattern (ex.—in a monopole-like pattern). In further embodiments of the present disclosure, the central element 110 may be configured for being connected to a feed line (exs.—a Radio Frequency (RF) feed line, coaxial cable, printed circuit transmission line (such as microstrip, stripline, etc.), and/or the like) 112.

Figure 4:
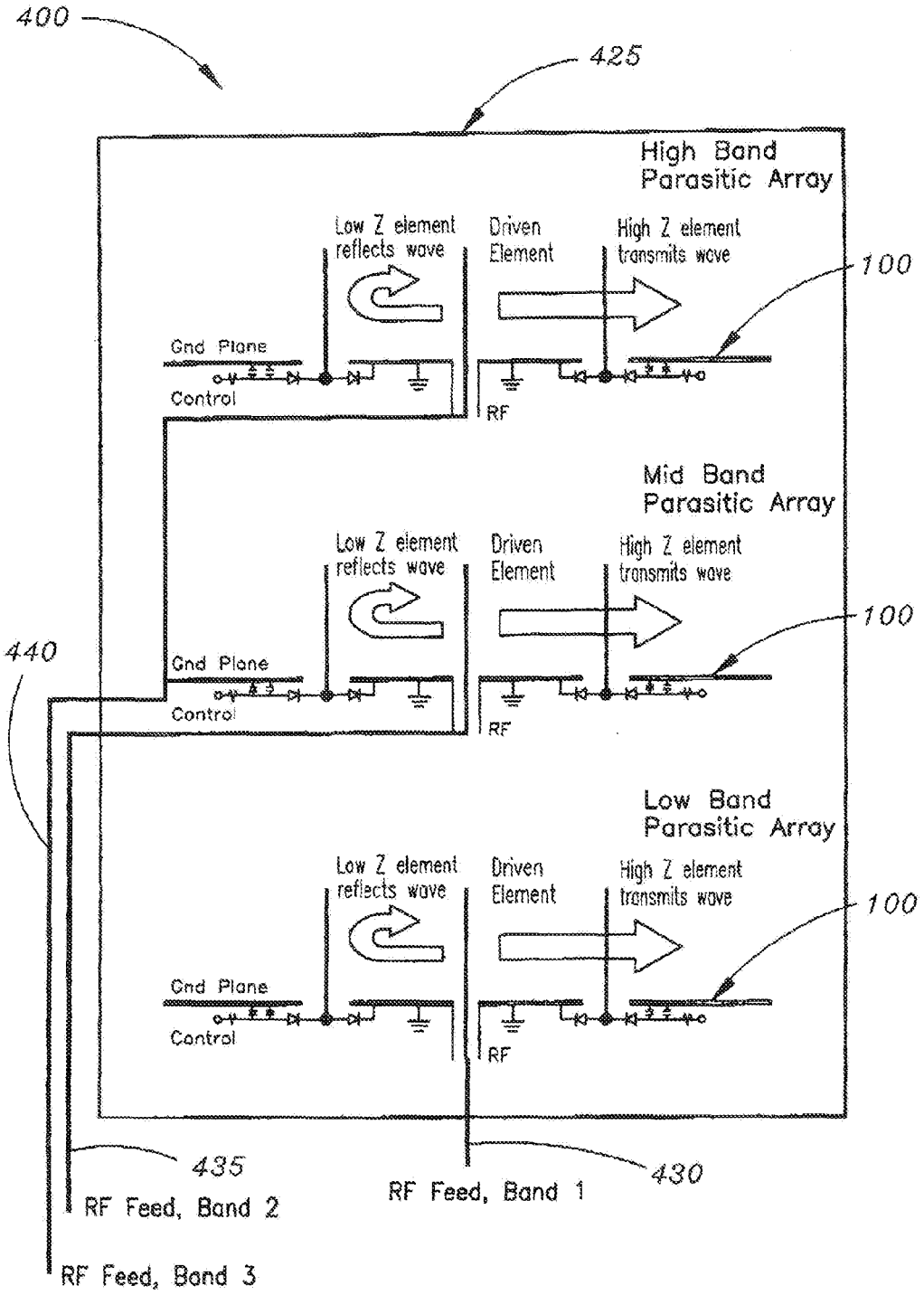
FIG. 4 is a stacked parasitic array, said stacked parasitic array including a plurality of parasitic antenna array arranged in a stacked configuration, said stacked parasitic array being configured for multiband operation and further being configured with separate, external feeds for each parasitic antenna array of the stacked parasitic array in accordance with a further exemplary embodiment of the present disclosure.

In exemplary embodiments of the present disclosure, the parasitic antenna array 100 may further include a plurality of parasitic elements (ex.—parasitic pins) 114. In the illustrated embodiment, the parasitic antenna array 100 includes six parasitic elements 114. However, varying numbers of parasitic elements 114 may be implemented in the parasitic antenna array 100 of the present disclosure. In further embodiments, the parasitic elements 114 may be connected to the substrate 102 and may be configured (exs.—oriented, arranged, located, established) in a generally circular arrangement so as to at least substantially surround (exs.—form a ring-like arrangement around, encircle) the central monopole element 110, wherein said central monopole element 110 may be generally centrally located within (ex.—may form the hub of) the ring created by the plurality of parasitic elements 114. In the illustrated embodiment of the present disclosure, one ring of parasitic elements 114 is established around the central monopole element 110. In alternative embodiments of the present disclosure, as shown in FIG. 4 and as discussed below, multiple rings of parasitic elements 114 may be configured around the central monopole element 110 for increasing gain of directional beams radiated by the parasitic antenna array 100.

In current exemplary embodiments of the present disclosure, each parasitic element 114 may be connected to a load (exs.—a load circuit, a variable impedance load) 116. For example, each parasitic element 114 may have a corresponding load circuit 116 connected (ex.—physically and electrically) to a base portion of said parasitic element 114 (as shown in FIG. 2A). In further embodiments, each load circuit 116 may be connected (ex.—physically and electrically) to the ground plane 108 configured on the bottom surface 106 of the substrate 102 (as shown in FIG. 2A). In still further embodiments of the present disclosure, each load circuit 116 may be an adjustable load circuit (ex.—an adjustable load) 116. Further, each load circuit 116 may be a parasitic load circuit (ex.—a parasitic load) 116.

Referring generally to FIG. 2A, a parasitic element 114 which is connected to its corresponding load circuit 116 is shown. In exemplary embodiments of the present disclosure, the load circuit 116 may include a plurality of diodes 118. For example, the load circuit 116 may include two diodes 118, such as two p-type, intrinsic, n-type (PIN) diodes 118. In further embodiments of the present disclosure, the load circuit 116 may further include one or more capacitors 120, the one or more capacitors 120 configured for being connected to at least one of the PIN diodes 118. In still further embodiments of the present disclosure, the load circuit 116 may further include a resistor 122, the resistor 122 configured for being connected to at least one of the one or more capacitors 120. In further embodiments of the present disclosure, the load circuit 116 may further include a Direct Current (DC) bias current source 124, the DC bias current source 124 configured for being connected to the resistor 122.

In current exemplary embodiments of the present disclosure, the two PIN diodes 118 of the load circuit 116 may be configured for being connected to each other. Further, the load circuit's corresponding parasitic element 114 may be configured for being connected between the two PIN diodes 118. Further, one of the two PIN diodes 118 may be configured for directly connecting the parasitic element 114 to the ground plane, while the other of the two PIN diodes 118 may be configured for connecting the parasitic element 114 to the ground plane 108 through one or more low impedance capacitors 120.

In exemplary embodiments of the present disclosure, the DC bias current source 124 may be configured for providing DC bias current to the resistor 122. The DC bias current may be transmitted through (ex.—may pass through) the resistor, thereby producing a voltage across the resistor 122. In further embodiments, the resistor 122 and capacitor(s) 120 may form a low pass filter for providing the DC bias current to the diodes 118. For example, in at least one embodiment, when electromagnetic energy is radiated by the monopole element 110, it may contact a parasitic element 114 and the electromagnetic energy (ex.—RF energy) may flow from the parasitic element 114 to a diode 118 of the load circuit 116 for that parasitic element and the RF energy may be shorted from the diode 118 directly to the ground plane 108 via the capacitor(s) 120. In still further embodiments, the resistor 122 may be small and/or may be sized to set a desired current level for a desired voltage.

Figure 3:
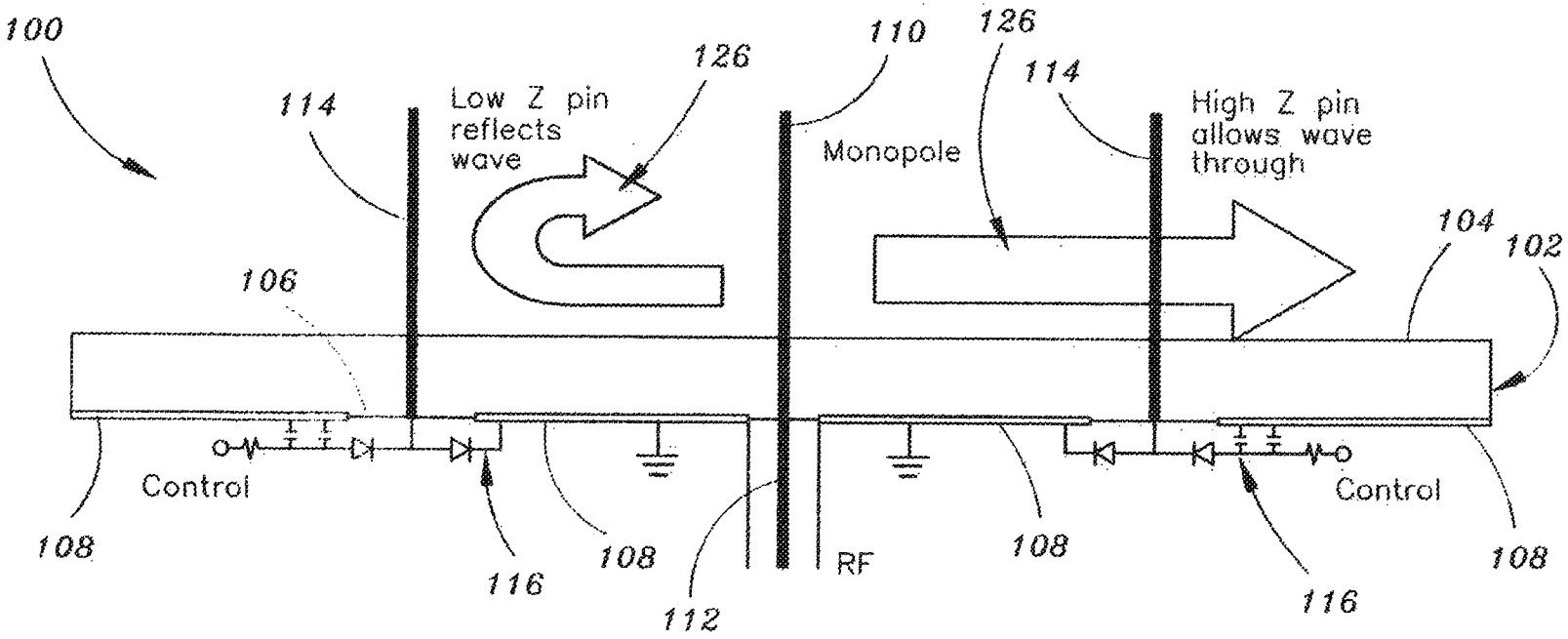
FIG. 3 is a block diagram schematic illustrating the operation of the parasitic antenna array shown in FIG. 1 in accordance with a further exemplary embodiment of the present disclosure.

In current exemplary embodiments of the present disclosure, the load circuit (ex.—variable impedance load) 116 may be configurable for allowing a variable (ex.—adjustable) impedance to be applied to the load circuit's corresponding parasitic element 114. As mentioned above, the monopole element 110 may be configured for receiving RF energy via the feed line 112 (as shown in FIG. 3). Further, based upon the received RF energy, the monopole element 110 may be configured for radiating electromagnetic energy (ex.—electromagnetic waves 126) in multiple directions (ex.—towards multiple parasitic elements 114 of the array 100). The electromagnetic waves 126 may excite a voltage (ex.—an applied voltage) on multiple parasitic elements 114. The relationship of the voltage and current present on a particular parasitic element 114 may be determined by the impedance (Z) applied to that parasitic element 114 via its load circuit 116 (ex.—a change in the voltage and current for the parasitic element 114 means that applied impedance provided via the load circuit 116 for that parasitic element 114 is changed also). For instance, when the applied impedance provided to a parasitic element 114 via its corresponding load circuit 116 is low (ex.—low Z), the current on that parasitic element 114 may be high (ex.—may be higher than the current present on the monopole element 110), which may cause the parasitic element 114 to reflect a wave radiated by the monopole 110 (as shown in FIG. 3). Further, when the applied impedance provided to a parasitic element via its corresponding load circuit 116 is high (ex.—high Z), the current on that parasitic element 114 may be low (ex.—may be lower than the current present on the monopole element 110), which may cause the parasitic element 114 to be transparent to a wave radiated by the monopole 110 (ex.—the parasitic element 114 may allow a wave radiated by the monopole 110 to pass through it). Thus, the applied impedance provided to each parasitic element 114 via its corresponding load circuit 116 may be selectively varied for causing the parasitic antenna array 100 to take (ex.—manipulate) the omni-directional monopole field radiated by the monopole element 110 and to radiate either multiple directional beams (ex.—azimuthal directional beams) or an omni-beam (ex.—a monopole-like radiation pattern). The parasitic antenna array 100 of the present disclosure is configured for applying the variable impedance to the parasitic elements 114 (via the variable impedance loads 116) for causing the antenna array 100 to produce a desired radiation pattern, and, unlike currently available parasitic antenna arrays, the parasitic antenna array 100 of the present disclosure is configured for doing this efficiently even at high (ex. −15 GHz) frequencies.

Figure 2B:
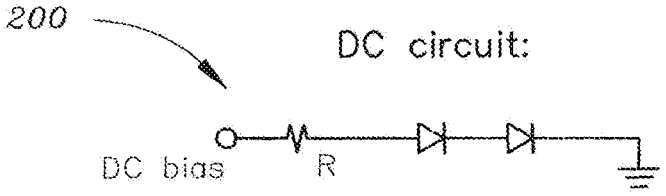
FIG. 2B is a block diagram schematic illustrating the operation of the load circuit shown in FIG. 2A when the parasitic antenna array is operating at low frequencies (ex. ~3 GHz) in accordance with a further exemplary embodiment of the present disclosure.
Figure 2C:
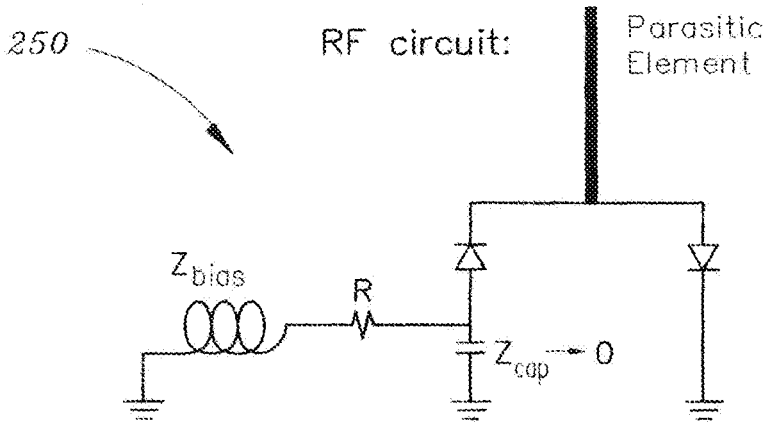
FIG. 2C is a block diagram schematic illustrating the operation of the load circuit shown in FIG. 2A when the parasitic antenna array is operating at high frequencies (ex. ~15 GHz) in accordance with a still further exemplary embodiment of the present disclosure.

In exemplary embodiments of the present disclosure, it is the diodes 118 of each load circuit 116 which may control the RF load of each parasitic element, thereby affecting mutual coupling and reflectivity of the parasitic antenna array 100. In current exemplary embodiments of the present disclosure, depending upon the frequencies at which the parasitic antenna array 100 is operating at during a given time, the load circuit 116 may be configured for operating as a DC circuit or an RF circuit. For instance, when the parasitic antenna array 100 is operating at lower frequencies (ex. −3 GHz or below), each load circuit 116 may be configured for operating as a DC circuit 200 (as shown in FIG. 2B) in which the diodes 118 are placed in (ex.—connected in) series, thereby allowing the total DC current draw to be the same as a load circuit which implements only a single diode. As mentioned above, the parasitic antenna array 100 of the present disclosure is configured for applying the variable impedance to the parasitic elements 114 (via the variable impedance loads 116) for causing the antenna array 100 to produce a desired radiation pattern, and is configured for doing this efficiently even at high (ex. −15 GHz) frequencies. For instance, when the parasitic antenna array 100 is operating at higher frequencies (ex. −15 GHz), each load circuit 116 may be configured for operating as an RF circuit 250 (as shown in FIG. 2C) in which the diodes 118 are in parallel and any undesired impedance from the DC bias current source (ex.—DC bias circuit) 124 is shorted out by the parallel diode 118 tied directly to ground 108, thereby allowing the parasitic antenna array 100 of the present disclosure to provide dramatically improved performance and efficiency at higher frequencies relative to currently available parasitic antenna arrays 100.

The parasitic antenna array 100 of the present disclosure may provide improved RF and DC performance over currently available parasitic antenna arrays because the parasitic antenna array 100 of the present disclosure does not implement a biasing scheme which depends upon inductors (inductors may often be impractical and lossy at high frequencies), nor does the parasitic antenna array 100 of the present disclosure implement a biasing scheme which depends upon quarter wave matching sections (quarter wave matching sections may often be lossy and band limiting), nor does the parasitic antenna array 100 of the present disclosure implement a biasing scheme which depends upon large blocking resistors (large blocking resistors may be impractical for current-controlled devices).

Further, the parasitic antenna array 100 of the exemplary embodiments of the present disclosure may be configured for usage (ex.—practical usage) at higher microwave frequencies, such as up to Ku band (ex. −15 Gigahertz (GHz)). For example, the parasitic antenna array 100 of the present disclosure may exhibit a directional gain which is greater than 5 dBi (decibels (isotropic)) at 15 GHz. Further, the parasitic antenna array 100 of the exemplary embodiments of the present disclosure may be configured for being omni-directional, may be suitable for mobile microwave Intelligence Surveillance Reconnaissance (ISR) data links (ex.—ISR applications), and/or may be suitable for Unmanned Aerial Vehicles (UAV) applications, hand-held applications, soldier platforms, Miniature Common Data Link (MiniCDL) applications, and/or Quint Networking Technology (QNT) applications. Still further, the parasitic antenna array 100 of the present disclosure may represent a significant size, weight, power and cost (SWAP-C) improvement (exs.—smaller SWAP-C, greater than 50 times size, weight and cost reduction) compared to currently available Ku band antennas (ex.—Intelligence Surveillance and Reconnaissance (ISR) Ku band antennas).

Because the parasitic antenna array 100 of the present disclosure distributes thermal load across two devices (ex.—across two PIN diodes 118), the parasitic antenna array 100 of the present disclosure may provide improved power handling over currently available parasitic antenna arrays. Further, because the parasitic antenna array 100 of the exemplary embodiments of the present disclosure may dissipate power across multiple diodes 118, the parasitic antenna array of the present disclosure may be configured for achieving higher power operation (ex.—greater than 20 Watts (>20 W)) than currently available parasitic antenna arrays.

In further embodiments of the present disclosure, all interconnects for the parasitic antenna array 100 may be configured for being as short as possible, so as to remove any undesired impedances (ex.—undesired stray impedances). Further, because the ground plane 108 of the parasitic antenna array 100 of the present disclosure is configured on the same side (ex.—the bottom 106) of the substrate 102 as the load circuit 116, this eliminates the need for the parasitic antenna array 100 of the present disclosure to have inductive vias. This is advantageous as inductive vias often add significant impedance at high frequencies.

In exemplary embodiments of the present disclosure, large resistances may be placed in parallel with each diode 118 to balance reverse bias voltage across the diodes 118, such as when said diodes 118 are not well-matched. Said balancing of reverse bias voltage across the diodes 118 may be performed without significantly impacting RF performance.

In further alternative embodiments of the present disclosure, other two-terminal variable impedance devices may be implemented, such as varactor diodes and/or variable capacitors. Further, in some applications, FET switching transistors or any other transistor switch technologies may be substituted for PIN diode switches.

Figure 5:
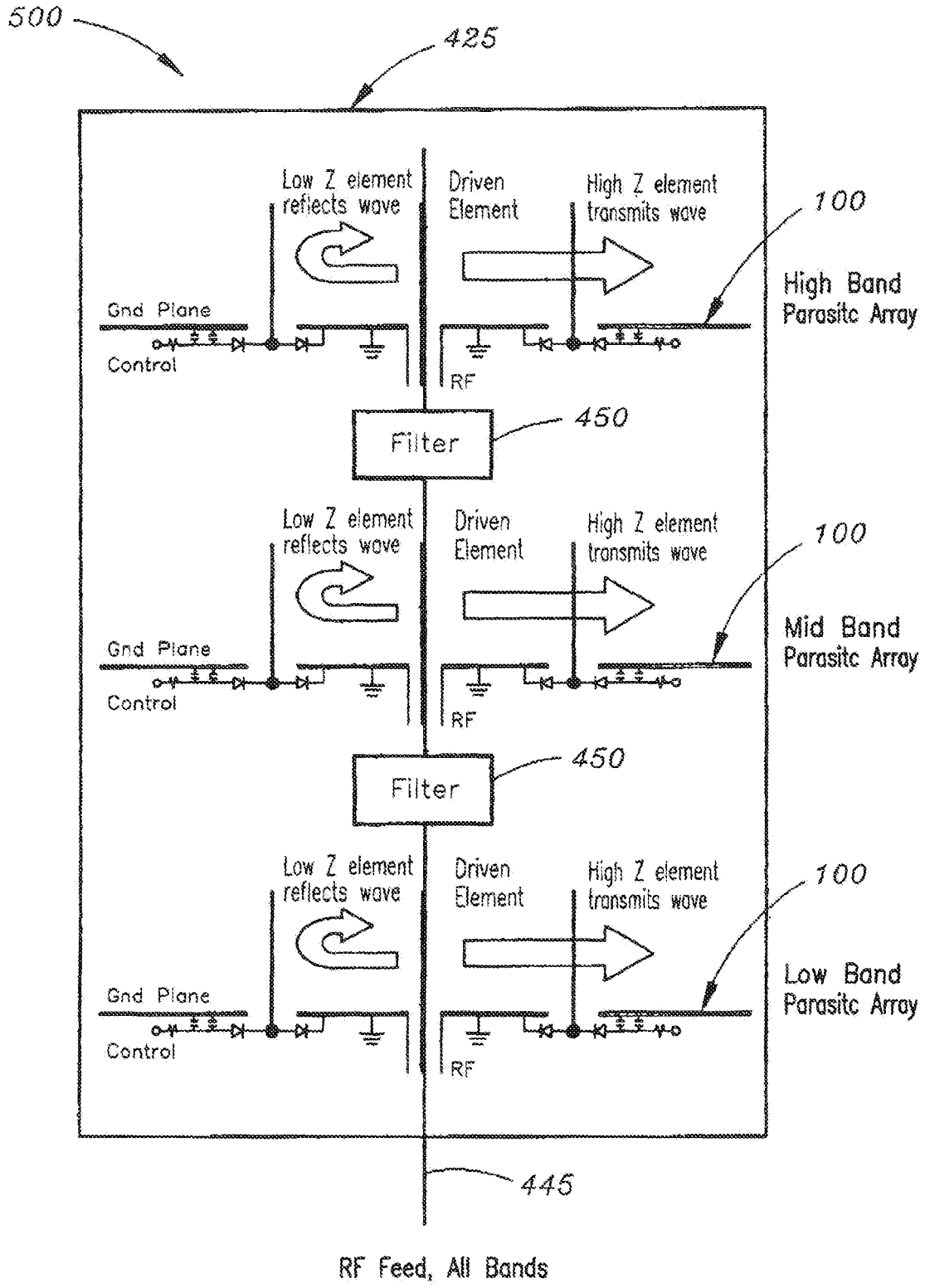
FIG. 5 is a stacked parasitic array which is configured for multiband operation, said stacked parasitic array including frequency selective circuitry placed in series with a central feed for exciting the parasitic antenna arrays of the stacked parasitic arrays with their corresponding frequency bands in accordance with a further exemplary embodiment of the present disclosure.

Referring to FIGS. 4 and 5, stacked parasitic arrays 400, 500 in accordance with exemplary embodiments of the present disclosure are shown. The stacked parasitic arrays (400, 500) may each include a plurality of parasitic antenna arrays 100. For instance, in the embodiments illustrated in FIGS. 4 and 5, the stacked parasitic arrays (400, 500) may each include three parasitic antenna arrays 100 which are arranged in a stacked configuration (exs.—are stacked upon one another, form a vertical stack). In exemplary embodiments, the stacked parasitic arrays (400, 500) may each include a housing (ex.—radome) 425 for encasing the plurality of parasitic antenna arrays 100. For example, the radome 425 may be an extruded, cylindrically-shaped radome 425.

In the embodiments shown in FIGS. 4 and 5, each parasitic antenna array (ex.—layer) 100 of the stacked parasitic arrays (400, 500) may be configured for being independently tuned (ex.—tuned to different RF bands) and switched between for allowing the stacked parasitic arrays (400, 500) to provide multiband operation. For example, the first parasitic antenna array included in the plurality of parasitic antenna arrays 100 may be tuned to a first RF frequency band (ex.—may be a low band parasitic array), the second parasitic antenna array included in the plurality of parasitic antenna arrays 100 may be tuned to a second RF frequency band (ex.—may be a mid band parasitic array), and the third parasitic antenna array included in the plurality of parasitic antenna arrays 100 may be tuned to a third RF frequency band (ex.—may be a high band parasitic array). Further, frequency values of the second frequency band may be higher (ex.—larger) than frequency values of the first frequency band, while frequency values of the third frequency band may be higher (ex.—larger) than frequency values of the second frequency band.

In further embodiments, each of the stacked parasitic arrays (400, 500) may be configured for being connected to at least one RF feed and control line(s) (ex.—coaxial cable(s)), said RF feed and control line(s) being configured for providing RF energy to the central monopole elements 110 of the parasitic antenna arrays 100. In the embodiment of the stacked parasitic array 400 shown in FIG. 4, said stacked parasitic array 400 is configured for being connected to a plurality of RF feed and control lines. For instance, if stacked parasitic array 400 has three parasitic antenna arrays 100 as mentioned above, a first parasitic antenna array included in the plurality of parasitic antenna arrays 100 of the stacked parasitic array 400 may be connected to a first RF feed and control line 430, a second parasitic antenna array included in the plurality of parasitic antenna arrays 100 may be connected to a second RF feed and control line 435, and a third parasitic antenna array included in the plurality of parasitic antenna arrays 100 may be connected to a third RF feed and control line 440. The first RF feed and control line 430 may be configured for exciting the first parasitic antenna array 100 (ex.—the low band parasitic array) with the first parasitic antenna array's corresponding frequency band (ex.—Band 1), the second RF feed and control line 435 may be configured for exciting the second parasitic antenna array 100 (ex.—the mid band parasitic array) with the second parasitic antenna array's corresponding frequency band (ex.—Band 2), and the third RF feed and control line 440 may be configured for exciting the third parasitic antenna array 100 (ex.—the high band parasitic array) with the third parasitic antenna array's corresponding frequency band (ex.—Band 3). In the exemplary embodiment of the stacked parasitic array 400 shown in FIG. 4, the RF feed and control lines (430, 435, 440) may be brought out external to the stacked parasitic array 400 and may be wrapped around portions of the stacked parasitic array 400 (exs.—around exterior portions of the array 400, around cylindrical portions of the array 400) at angle(s) for minimizing interference with radiation, as described in U.S. Pat. No. 5,534,880 entitled: Stacked Biconical Omnidirectional Antenna which is herein incorporated by reference.

In the embodiment shown in FIG. 5, the stacked parasitic array 500 is configured for being connected to a single, centrally-located RF feed and control line 445. For instance, if the stacked parasitic array 500 has three parasitic antenna arrays 100 as mentioned above, each of the three parasitic antenna arrays 100 may be connected to the RF feed and control line 445. Further, frequency-selective circuitry (ex.—one or more frequency-selective high pass filters) 450 may be placed in series with the central RF feed 445 for allowing each of the parasitic antenna arrays (ex.—layers) 100 of the stacked parasitic array 500 to be excited, via the central RF feed 445, with the parasitic antenna arrays' corresponding frequency bands for allowing said array 500 to provide multiband operation.

Figure 6:
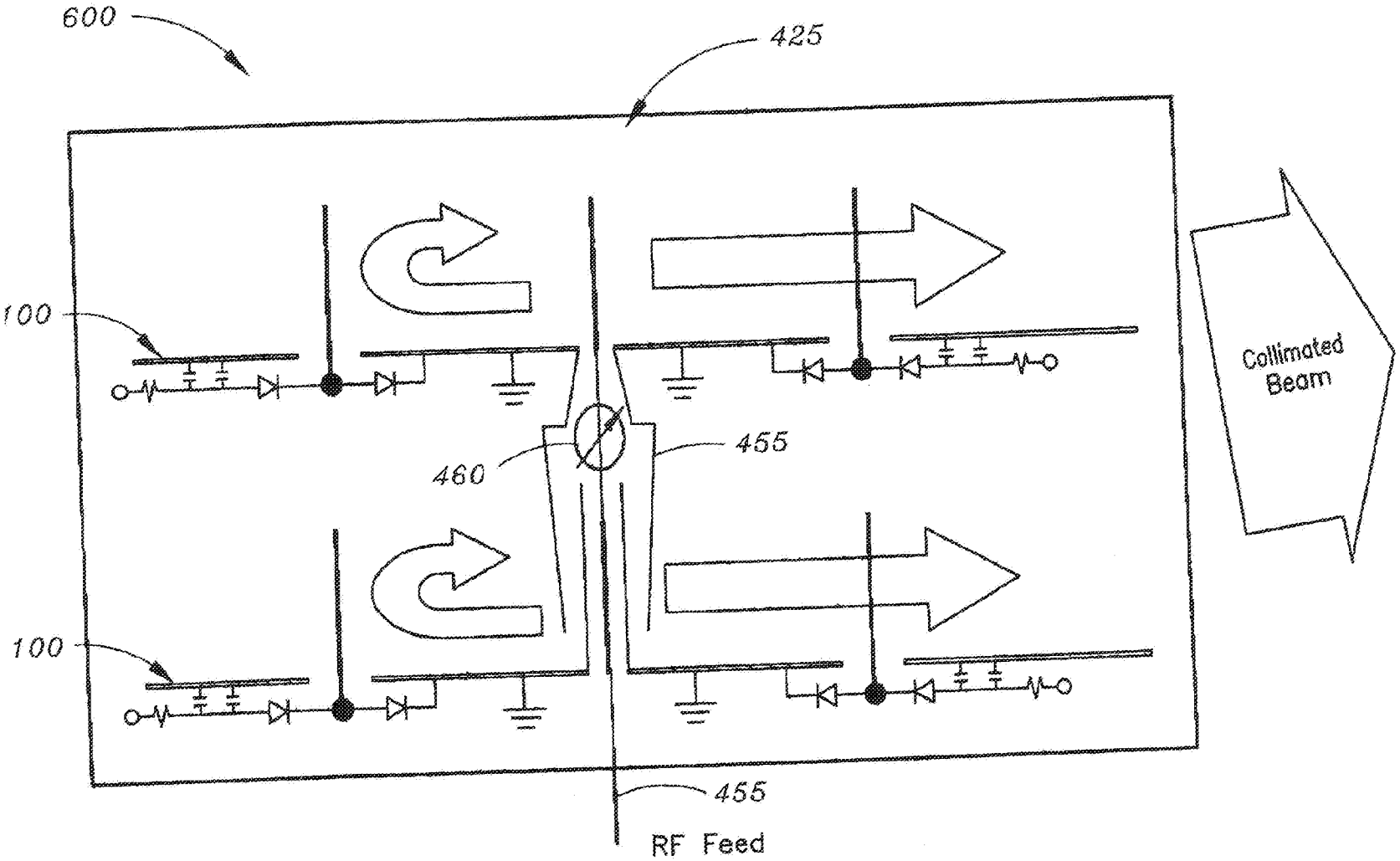
FIG. 6 is a stacked parasitic array which is configured for common band and is fed coherently as a collinear array via a central series feed in accordance with a further exemplary embodiment of the present disclosure.

Referring to FIG. 6, a stacked parasitic array 600 in accordance with a further exemplary embodiment of the present disclosure is shown. The stacked parasitic array 600 may include a plurality of parasitic antenna arrays 100 which are connected to each other. For instance, in the embodiments illustrated in FIG. 6, the stacked parasitic array 600 may include two parasitic antenna arrays 100 which are arranged in a stacked configuration (exs.—are stacked upon one another, are vertically stacked). In exemplary embodiments, the stacked parasitic array 600 may include a housing (ex.—radome) 425 for encasing the plurality of parasitic antenna arrays 100. For example, the radome 425 may be an extruded, cylindrically-shaped radome 425.

In further embodiments, the stacked parasitic array 600 may be configured for being connected to a central series feed 455 (ex.—a la stacked biconical arrays) said central series feed 455 being configured for providing RF energy to the central monopole elements 110 of the parasitic antenna arrays 100. In still further embodiments, a phase shifter 460 may be connected to (ex.—connected between) the first parasitic antenna array and second parasitic antenna arrays (ex.—the first and second parasitic array layers) for promoting elevation beam steering of the stacked parasitic array 600 and for controlling a phase of each parasitic antenna array 100 of the stacked parasitic array 600. In exemplary embodiments, the parasitic antenna arrays (ex.—layers) 100 of the stacked parasitic array 600 may be designed for common band and may be configured for being fed coherently as a collinear array via the central series feed 455, such that the layers 100 of the array 600 are excited concurrently (ex.—simultaneously) for promoting improved gain (ex.—increased elevation gain) and improved elevation beam steering over currently available parasitic arrays.

Figure 7:
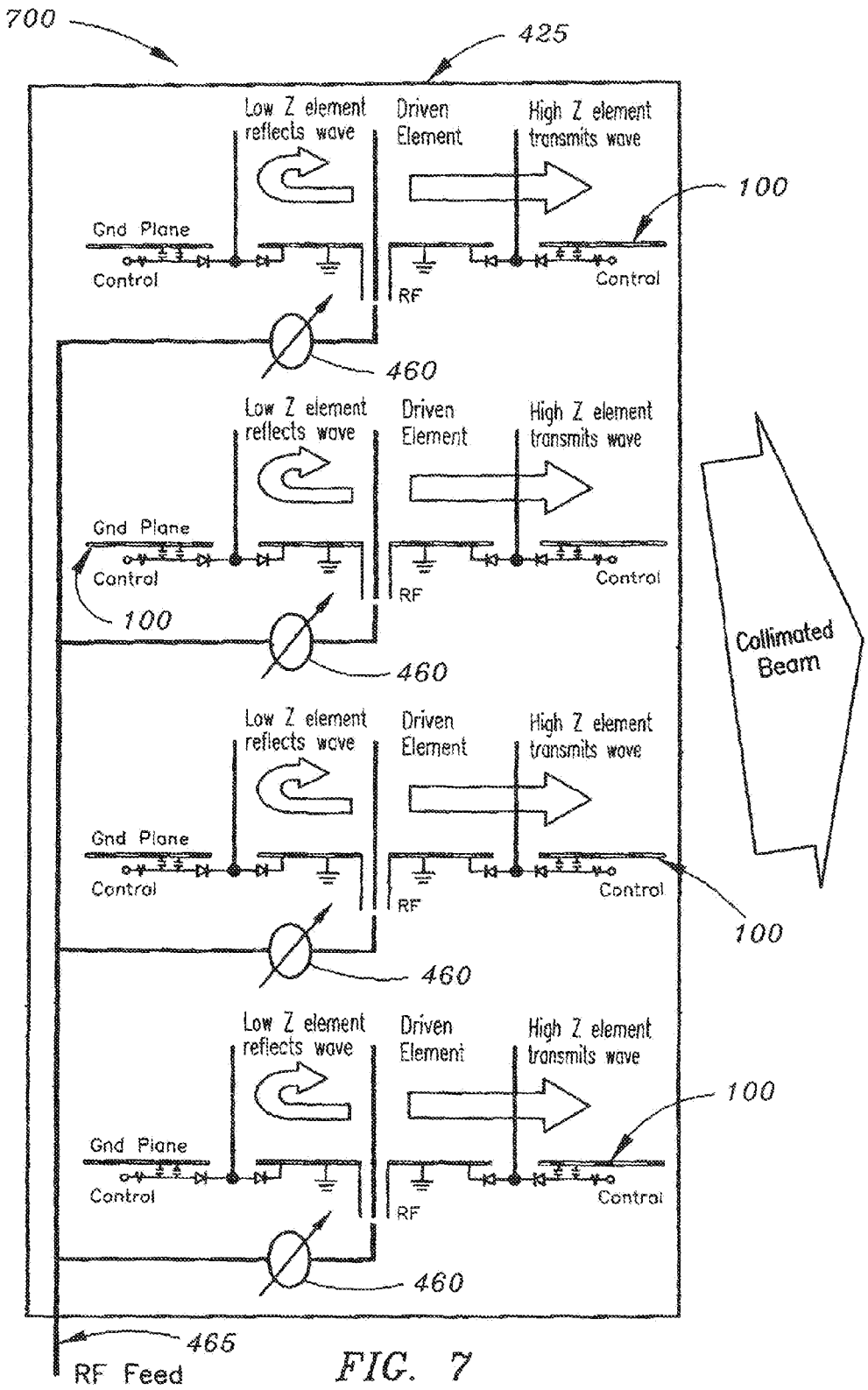
FIG. 7 is a stacked parasitic array which is configured for common band and is fed coherently as a collinear array via a series feed which is run external to the stacked parasitic array in accordance with a further exemplary embodiment of the present disclosure.
Figure 8:
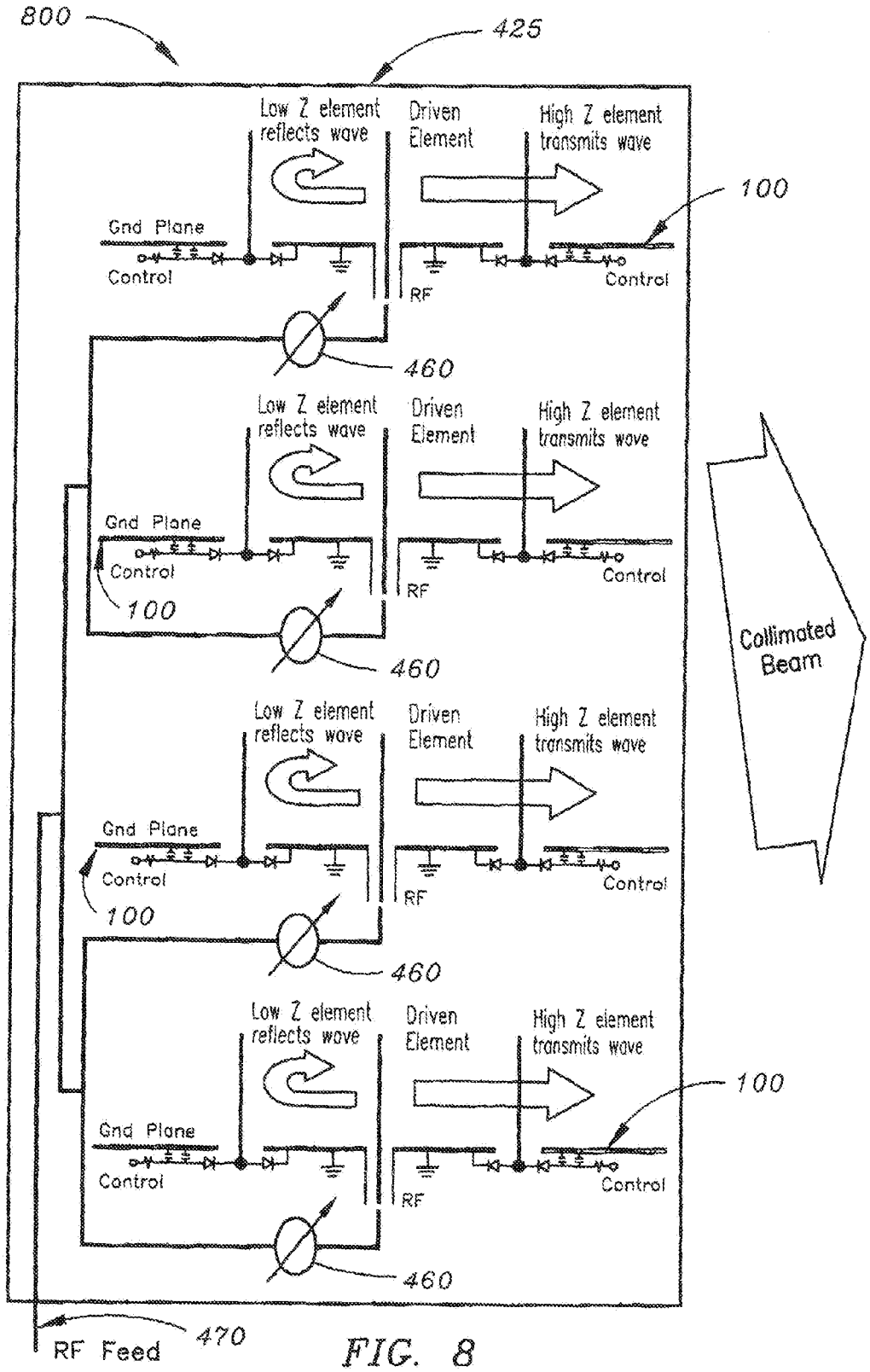
FIG. 8 is a stacked parasitic array which is configured for common band and is fed coherently as a collinear array via a corporate feed which is run external to the stacked parasitic array in accordance with a further exemplary embodiment of the present disclosure.

Referring to FIGS. 7 and 8, stacked parasitic arrays 700, 800 in accordance with further exemplary embodiments of the present disclosure are shown. The stacked parasitic arrays (700, 800) may each include a plurality of parasitic antenna arrays 100. For instance, in the embodiments illustrated in FIGS. 7 and 8, the stacked parasitic arrays (700, 800) may each include four parasitic antenna arrays 100 which are arranged in a stacked configuration (exs.—are stacked upon one another, are vertically stacked). In exemplary embodiments, the stacked parasitic arrays (700, 800) may each include a housing (ex.—radome) 425 for encasing the plurality of parasitic antenna arrays 100. For example, the radome 425 may be an extruded, cylindrically-shaped radome 425.

In further embodiments, each of the stacked parasitic arrays (700, 800) shown in FIGS. 7 and 8 may be configured for being connected to at least one RF feed and control line(s) (ex.—coaxial cable(s)), said RF feed and control line(s) being configured for providing RF energy to the central monopole elements 110 of the parasitic antenna arrays 100. For example, the stacked parasitic array 700, as shown in FIG. 7, may be configured for being connected to a series feed 465 (ex.—an external series feed 465), said external series feed 465 being configured for providing RF energy to the central monopole elements 110 of each of the parasitic antenna arrays (layers) 100 of the stacked parasitic array 700. The external series feed 465 may be brought out external to the stacked parasitic array 700 and may be wrapped around portions of the stacked parasitic array 700 (exs.—around exterior portions of the array 700, around cylindrical portions of the array 700) at angle(s) for minimizing interference with radiation. In still further embodiments, phase shifters 460 may be connected to (ex.—connected between) the parasitic antenna arrays 100 for promoting elevation beam steering of the stacked parasitic array 700 and for controlling a phase of each parasitic antenna array 100 of the stacked parasitic array 700. In exemplary embodiments, the parasitic antenna arrays (ex.—layers) 100 of the stacked parasitic array 700 may be designed for common band and may be configured for being fed coherently as a collinear array via the external series feed 465, such that the layers 100 of the array 700 are excited concurrently (ex.—simultaneously) for promoting improved gain (ex.—increased elevation gain) and improved elevation beam steering over currently available parasitic arrays.

Referring to FIG. 8, the stacked parasitic array 800 may be configured for being connected to a corporate feed 470 (ex.—an external corporate feed 470), said external corporate feed 470 being configured for providing RF energy to the central monopole elements 110 of each of the parasitic antenna arrays (ex.—layers) 100 of the stacked parasitic array 800. The external corporate feed 470 may be brought out external to the stacked parasitic array 800 and may be wrapped around portions of the stacked parasitic array 800 (exs.—around exterior portions of the array 800, around cylindrical portions of the array 800) at angle(s) for minimizing interference with radiation. In still further embodiments, phase shifters 460 may be connected to (ex.—connected between) the parasitic antenna arrays 100 for promoting elevation beam steering of the stacked parasitic array 800 and for controlling a phase of each parasitic antenna array 100 of the stacked parasitic array 800. In exemplary embodiments, the parasitic antenna arrays (ex.—layers) 100 of the stacked parasitic array 800 may be designed for common band and may be configured for being fed coherently as a collinear array via the external corporate feed 470, such that the layers 100 of the array 800 are excited concurrently (ex.—simultaneously) for promoting improved gain and improved elevation beam steering over currently available parasitic arrays. For instance, for stacked parasitic arrays which are implementing four stacked layers 100, such as the stacked parasitic arrays (700, 800) shown in FIGS. 7 and 8, the overall gain for such arrays (700, 800) may be greater than 18 dBi.

In exemplary embodiments of the present disclosure, the stacked parasitic arrays (600, 700, 800) discussed above which are fed coherently as collinear arrays may each be configured for producing a collimated beam based upon a received RF feed. Further, the stacked parasitic arrays (600, 700, 800) discussed above which are fed coherently as collinear arrays may each implement parasitic array steering for accomplishing azimuthal beam steering.

In further embodiments, one or more of the stacked parasitic array embodiments described above may implement Circular Switched Parasitic Array (CSPA) or Electronically Steerable Parasitic Array Radiator (ESPAR) technology. As discussed above, phase shifters 460 may be implemented in the stacked parasitic arrays (600, 700, 800) shown in FIGS. 6, 7 and 8. In alternative embodiments, rather than implementing phase shifters 460, the stacked parasitic arrays (600, 700, 800) shown in FIGS. 6, 7 and 8 may implement static delay line(s), or true time delay(s) (TTD). In further embodiments, the phase shifter(s) 460, static delay line(s), and/or TTD(s) may be static or may be electronically controlled for steering in elevation.

As mentioned above, one or more of the stacked parasitic array embodiment(s) described herein may be configured for providing a frequency scalable design by being configurable for providing multiband and/or wideband operation (ex.—L-band (1 GHz) to $K_u$ band (15 GHz)). In further embodiments, any one or more of the above-described feeds (430, 435, 440, 445, 455, 465, 470) may be treated with a material(s) (exs.—ferrite absorptive material (such as via liquid moldable ferrite loading), stealthy MetaMaterial, and/or the like) for minimizing the effect of parasitic electromagnetic (EM) wave scattering for edge combiner structures and/or for allowing the feeds to minimize EM wave scattering off of themselves (ex.—such as by bending EM waves around the structure). This may be particularly useful as array operating frequency increases.

It is believed that the present disclosure and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A stacked parasitic array, comprising:

a first parasitic antenna array comprising a substrate, a centrally-driven monopole element, a first ground plane, a plurality of parasitic monopole elements, and a plurality of load circuits, said centrally-driven monopole element being connected to said substrate to radiate electromagnetic energy in an omni-directional radiation pattern, said first ground plane being connected to a surface of the substrate, said plurality of parasitic monopole elements being connected to the substrate and substantially surrounding the centrally driven monopole element, said plurality of load circuits being connected to the plurality of parasitic monopole elements and being connected to the first ground plane; and a second parasitic antenna array comprising a second ground plane, the second parasitic antenna array and the first parasitic antenna array being arranged in a stacked configuration forming the stacked parasitic array with the second ground plane of the second parasitic antenna array being orthogonal to a parasitic monopole element of the plurality of parasitic monopole elements of the first parasitic antenna array, said stacked parasitic array being configured for multiband operation.

2. A stacked parasitic array as claimed in claim 1, wherein the first parasitic antenna array and the second parasitic array are configured for being independently tuned, said first parasitic antenna array configured for being tuned to a first frequency band, said second parasitic antenna array configured for being tuned to a second frequency band, the second frequency band being different from the first frequency band.

3. A stacked parasitic array as claimed in claim 1, wherein the first parasitic antenna array and the second parasitic antenna array are configured for being concurrently tuned, said first parasitic antenna array and said second parasitic array being configured for being tuned to a same frequency band.

4. A stacked parasitic array as claimed in claim 2, wherein a frequency selective filter is connected to each of the first parasitic antenna array and the second parasitic array and is connected between the first parasitic antenna array and the second parasitic antenna array.

5. A stacked parasitic array as claimed in claim 4, further comprising:

a second centrally-driven monopole element associated with the second parasitic antenna array, wherein the centrally-driven monopole element is a first centrally-driven monopole element, and wherein the first parasitic antenna array and the second parasitic antenna array are configured for being connected to a Radio Frequency (RF) feed line, said RF feed line configured for providing a RF feed to the first parasitic antenna array for providing the electromagnetic energy to the first centrally-driven monopole element of the first parasitic antenna array, said RF feed line further configured for providing the RF feed to the frequency selective filter, said frequency selective filter configured for receiving the RF feed and for providing a filtered RF feed based upon the received RF feed to the second parasitic antenna array for providing the electromagnetic energy to the second centrally-driven monopole element of the second parasitic antenna array.

6. A stacked parasitic array as claimed in claim 2, wherein the first parasitic antenna array is connected to a first Radio Frequency (RF) feed line and the second parasitic antenna array is connected to a second RF feed line, and wherein the stacked parasitic array is configured for selecting between: causing said first RF feed line to provide a first RF feed to the first parasitic antenna array for providing the electromagnetic energy to the first centrally-driven monopole element of the first parasitic antenna array; and causing said second RF feed line to provide a second RF feed to the second parasitic antenna array for providing the electromagnetic energy to a second centrally-driven monopole element, the second centrally-driven monopole element associated with the second parasitic antenna array.

7. A stacked parasitic antenna array as claimed in claim 3, wherein the first parasitic antenna array and the second parasitic antenna array are connected to a Radio Frequency (RF) feed line, said RF feed line configured for concurrently providing a RF feed to the first parasitic antenna array and the second parasitic antenna array for providing electromagnetic energy concurrently to the first centrally-driven monopole element of the first parasitic antenna array and a second centrally-driven monopole element associated with the second parasitic antenna array.

8. A stacked parasitic antenna array as claimed in claim 7, wherein the RF feed is a central series feed.

9. A stacked parasitic antenna array as claimed in claim 7, wherein the RF feed is an external series feed.

10. A stacked parasitic antenna array as claimed in claim 7, wherein the RF feed is a corporate feed.

11. A stacked parasitic antenna array as claimed in claim 1, wherein each of the load circuits of said plurality of load circuits are configured for providing adjustable impedances to each parasitic monopole element of the plurality of parasitic monopole elements.

12. A stacked parasitic antenna array as claimed in claim 11, wherein each parasitic monopole element included in the plurality of parasitic monopole elements is selectively configurable to reflect the electromagnetic energy radiated from the centrally-driven monopole element or to allow transmission of the electromagnetic energy through a respective parasitic monopole element, and wherein each parasitic monopole element is selectively configurable based upon the adjustable impedance respectively provided to each parasitic monopole element.

13. A stacked parasitic array, comprising:

a first parasitic antenna array comprising a first centrally-driven monopole element and a first ground plane; and a second parasitic antenna array comprising a substrate, a second centrally-driven monopole element, a second ground plane, a plurality of parasitic monopole elements, and a plurality of load circuits, said second centrally-driven monopole element being connected to a first surface of said substrate to radiate electromagnetic energy in an omni-directional radiation pattern, said second ground plane being connected to a second surface of the substrate, the second surface of the substrate being a bottom surface of the substrate, said plurality of parasitic monopole elements being connected to the first surface of the substrate and substantially surrounding said second centrally-driven monopole element, said plurality of load circuits being connected to the plurality of parasitic monopole elements and being connected to the second ground plane, said plurality of load circuits providing an adjustable impedance, wherein the first parasitic antenna array and the second parasitic array are arranged in the stacked parasitic array with the first ground plane of the first parasitic antenna array being orthogonal to a parasitic monopole element of the plurality of parasitic monopole elements of the second parasitic antenna array, wherein each parasitic antenna array of the stacked parasitic array is configured for being independently tuned to effect multiband operation, and wherein independently tuned comprises tuning said first parasitic antenna array to a first frequency band and tuning said second parasitic antenna array to a second frequency band.

14. A stacked parasitic array as claimed in claim 13, further comprising:

a frequency selective filter connected between the first parasitic antenna array and the second parasitic antenna array.

15. A stacked parasitic array as claimed in claim 14, further comprising:

a Radio Frequency (RF) feed line configured for being connected to the first parasitic antenna array and the second parasitic antenna array, said RF feed line being further configured for providing a RF feed to the first parasitic antenna array for providing electromagnetic energy to the first centrally-driven monopole element of the first parasitic antenna array, said RF feed line further configured for providing the RF feed to the frequency selective filter, said frequency selective filter configured for receiving the RF feed and for providing a filtered RF feed based upon the received RF feed to the second parasitic antenna array for providing the electromagnetic energy to the second centrally-driven monopole element of the second parasitic antenna array.

16. A stacked parasitic array as claimed in claim 13, further comprising:

a first Radio Frequency (RF) feed line; and a second RF feed line, wherein the first RF feed line is connected to the first parasitic antenna array and the second RF feed line is connected to the second parasitic antenna array, and wherein each parasitic antenna array of said stacked parasitic array is configured for selecting between: causing said first RF feed line to provide a first RF feed to the first parasitic antenna array to provide electromagnetic energy to the first centrally-driven monopole element of the first parasitic antenna array, and causing said second RF feed line to provide a second RF feed to the second parasitic antenna array for providing the electromagnetic energy to the second centrally-driven monopole element of the second parasitic antenna array.

17. A stacked parasitic array, comprising:

a first parasitic antenna array comprising a first substrate, a first centrally-driven monopole element, a first ground plane, a first plurality of parasitic monopole elements, and a first plurality of load circuits, said first centrally-driven monopole element being parallel with said first plurality of parasitic monopole elements and being connected to a first surface of said first substrate to radiate first electromagnetic energy in a directional beam radiation pattern, said first ground plane being connected to a second surface of the first substrate, said second surface being a bottom surface of said first substrate, said first plurality of parasitic monopole elements being connected to the first substrate, said first plurality of load circuits being connected to the first plurality of parasitic monopole elements and being connected to the first ground plane, a load circuit of said first plurality of load circuits including a first plurality of diodes to provide a first selected applied impedance; and a second parasitic antenna array the second parasitic antenna array comprising a second substrate, a second centrally-driven monopole element, a second ground plane, a second plurality of parasitic monopole elements, and a second plurality of load circuits, said second centrally-driven monopole element being connected to a first surface of said second substrate and being configured to radiate second electromagnetic energy in a directional beam radiation pattern, said second ground plane being connected to a second surface of the second substrate, said second plurality of parasitic monopole elements being connected to the second substrate and located symmetrically around said second centrally-driven monopole element, said second plurality of load circuits being connected to the second plurality of parasitic monopole elements and being connected to the second ground plane, a load circuit of said second plurality of load circuits including a second plurality of diodes to provide a second selected applied impedance, wherein the first parasitic antenna array and the second parasitic antenna array are: arranged a stacked configuration causing the first ground plane of the first parasitic antenna array to be orthogonal to a parasitic monopole element of the second plurality of parasitic monopole elements of the second parasitic antenna array, tuned to a same frequency band, and configured for common band operation.

18. A stacked parasitic antenna array as claimed in claim 17, further comprising:

a Radio Frequency (RF) feed line connected to the first parasitic antenna array and the second parasitic antenna array, said RF feed line providing a RF feed to the first parasitic antenna array and the second parasitic antenna array for providing the first and second electromagnetic energies respectively to the first and second centrally-driven monopole elements of the first parasitic antenna array and the second parasitic antenna array, wherein the first plurality of diodes and the second plurality of diodes are implemented in a series or a parallel arrangement depending on a frequency band at which the first parasitic antenna array or the second parasitic antenna array operate.

19. A stacked parasitic antenna array as claimed in claim 18, wherein the RF feed line is configured for coherently providing the RF feed to the first parasitic antenna array and the second parasitic antenna array for providing the first and second electromagnetic energies concurrently to the first and second centrally-driven monopole elements of the first parasitic antenna array and the second parasitic antenna array.

20. A stacked parasitic antenna array as claimed in claim 18, wherein the RF feed is one of: a central series feed, an external series feed and a corporate feed.

21. A stacked parasitic array as claimed in claim 19, further comprising a first phase shifter connected to the first parasitic antenna array and a second phase shifter connected to the second parasitic antenna array, wherein each of the first phase shifter and the second phase shifter is configured for elevation beam steering and for controlling a phase of each the first parasitic antenna array and the second parasitic antenna array, wherein each of the first phase shifter and the second phase shifter is one of: a static controlled phase shifter and an electronically controlled phase shifter, and wherein the first parasitic antenna array and the second parasitic antenna array are excited concurrently to affect a gain of the stacked configuration.

* * * * *